US006644351B2

(12) United States Patent
LaMarca et al.

(10) Patent No.: US 6,644,351 B2
(45) Date of Patent: Nov. 11, 2003

(54) BOOSTER PILOT VALVE

(75) Inventors: Drew LaMarca, Whippany, NJ (US); Gregory J. Volz, Lincoln Park, NJ (US)

(73) Assignee: ASCO Controls, LP, Florham Park, NJ (US)

( * ) Notice: Subject to any disclaimer, the term of this patent is extended or adjusted under 35 U.S.C. 154(b) by 6 days.

(21) Appl. No.: 09/813,646

(22) Filed: Mar. 21, 2001

(65) Prior Publication Data

US 2001/0045537 A1 Nov. 29, 2001

Related U.S. Application Data

(60) Provisional application No. 60/192,119, filed on Mar. 24, 2000.

(51) Int. Cl.[7] ..... F15B 31/043

(52) U.S. Cl. ..... 137/625.64; 137/625.66; 137/625.68; 251/30.05

(58) Field of Search ..... 251/30.01, 30.02, 251/30.05; 137/625.68, 625.66, 625.64

(56) References Cited

U.S. PATENT DOCUMENTS 2,931,389 A * 4/1960 Moog, Jr. et al. ..... 137/625.62
3,977,438 A * 8/1976 Muchow et al. .... 137/625.68 X
3,983,908 A * 10/1976 Bartholomaeus ..... 137/625.62
4,456,031 A * 6/1984 Taplin ..... 137/625.64 X
4,615,353 A * 10/1986 McKee ..... 137/625.66 X
4,623,003 A * 11/1986 Leonard ..... 137/625.64 X
4,796,662 A * 1/1989 Hoffmann et al. ... 251/30.02 X
4,887,643 A 12/1989 Tomlin et al. ..... 137/625.66
4,907,615 A * 3/1990 Meyer et al. ..... 137/625.64 X
5,240,041 A * 8/1993 Garnjost ..... 137/625.64 X
5,538,026 A 7/1996 Kazi ..... 137/1
5,564,674 A 10/1996 Kalin et al. ..... 251/38
5,570,716 A * 11/1996 Kamen et al. ..... 251/30.02 X
5,579,676 A 12/1996 Wilke ..... 91/420
5,868,059 A * 2/1999 Smith ..... 251/30.02 X
5,878,647 A 3/1999 Wilke et al. ..... 91/445
5,901,749 A 5/1999 Watson ..... 137/625.66
6,024,200 A * 2/2000 Jang ..... 137/625.64
6,039,070 A 3/2000 Zaehe ..... 137/149

* cited by examiner

*Primary Examiner*—Gene Mancene
*Assistant Examiner*—Eric Keasel
(74) *Attorney, Agent, or Firm*—Howrey Simon Arnold & White LLP

(57) ABSTRACT

A booster pilot valve operable at ultra low power levels is provided. The booster valve includes a moveable spool capable of directing a fluid flow to at least two different paths. The booster valve may be coupled to a piezotronic three-way valve, which controls the movement of the spool by redirecting a main fluid flow along different paths to create a force on the spool. The piezotronic valve is capable of actuation at very low power levels such as might be provided by a Profibus PA or other Bus system.

29 Claims, 5 Drawing Sheets

BOOSTER PILOT VALVE

RELATION TO COPENDING APPLICATIONS

This Non-provisional Application claims the benefit of the Provisional Application No. 60/192,119 filed Mar. 24, 2000.

FIELD OF THE INVENTION

This invention relates generally to valve actuating methods and apparatus and, more particularly, to booster pilot valves.

BACKGROUND AND SUMMARY OF THE INVENTION

In recent years, industrial facilities, such as pharmaceutical or petrochemical plants, employ low-energy Bus systems to operate and control various processes. The low-energy Bus systems operate with currents ranging from 1.5 to 10 mA at an input voltage of 6 to 30 volts. The low-energy Bus systems consume less power than previously used operating and control systems. The use of low-energy Bus systems may reduce the overall operating expenses of the plants, among other advantages.

With the introduction of low-energy Bus systems has also come a demand for valves that operate with the limited power supply of the Bus system. Large valves typically require a considerable amount of power to open and close, more power than may be available through the low-energy Bus system. Consequently, it has become a common practice to mount an air-powered cylinder on or near a large valve to actuate it. The air cylinder is often actuated by a solenoid or a pilot valve that is in communication with the air cylinder. The pilot valve requires much less power than conventional valve actuators. Therefore, it is desirable to design a pilot valve that operates at the extremely low power levels of low-energy Bus systems to actuate a larger valve. In addition, it is desirable that the pilot valve be compatible with a particular Bus system being used in a plant.

The present invention is directed to providing a booster pilot valve operating at very low power levels to actuate a larger valve.

SUMMARY OF THE INVENTION

In accordance with one aspect of the present invention, a booster pilot valve includes a body and a hydraulic member. The body defines a fluid chamber. The hydraulic member is disposed in the fluid chamber and is movable by a pressurized flow between a first and a second position. The hydraulic member in the first position permits a cylinder port to communicate with a first ancillary port. The hydraulic member in the second position permits the pressurized flow to communicate with the cylinder port. In a further embodiment, the booster pilot valve includes a secondary device operable to direct the pressurized flow.

In accordance with another aspect of the present invention, a booster pilot valve includes a body and a spool. The body defines a fluid chamber having a main port and an outlet port. The spool is disposed within the fluid chamber and is movable by a pressurized flow between a closed position and an opened position. The spool in the closed position permits a secondary flow form a cylinder port to communicate with a first ancillary port. The spool in the opened position permits the pressurized flow from the main port to communication with the cylinder port. In a further embodiment, the booster pilot valve includes a secondary valve communicating with the outlet port of the body. The secondary valve is operable to direct the pressurized flow entering the main port to move the spool to the closed or opened position. The secondary valve may include a three-way valve or may include a piezotronic valve.

In accordance with yet another aspect of the present invention, a booster pilot valve includes a body and a hydraulic member. The body defines a fluid chamber and includes a main port and a stem. The main port is defined in a first end of the fluid chamber, and the stem protrudes into the fluid chamber from a second end. The stem defines an outlet port aligned with the main port. The hydraulic member is disposed in the fluid chamber and is movable between opened and closed positions within the fluid chamber. The hydraulic member includes first and second surfaces and a fluid passageway. The first surface is adjacent to the first end of the fluid chamber. The second surface is adjacent to the second end of the fluid chamber. The fluid passageway is defined in the hydraulic member and extends from the first surface to the second surface. The stem is partially disposed within the fluid passageway so that the fluid passageway communicates the main port with the outlet port. The hydraulic member in the opened position permits fluid communication of the main port with a cylinder port. The hydraulic member in the closed position permits fluid communication between the cylinder port and a first ancillary port.

In accordance with a further aspect of the present invention, a method of operating a valve element with a hydraulic device includes: supplying a pressurized flow into the hydraulic device; directing the pressurized flow to the valve element by selectively concentrating the pressurized flow to move the hydraulic device to an opened position; and directing a secondary flow from the valve element to an ancillary port in the hydraulic device by selectively concentrating the pressurized flow to move the hydraulic device to a closed position.

The foregoing summary is not intended to summarize each potential embodiment, or every aspect of the invention disclosed herein, but merely to summarize the appended claims.

BRIEF DESCRIPTION OF THE DRAWINGS

The present invention, including a preferred embodiment and other aspects, will be best understood with reference to the detailed description of specific embodiments of the invention, which follows, when read in conjunction with the accompanying drawings, in which.

Figure 1:
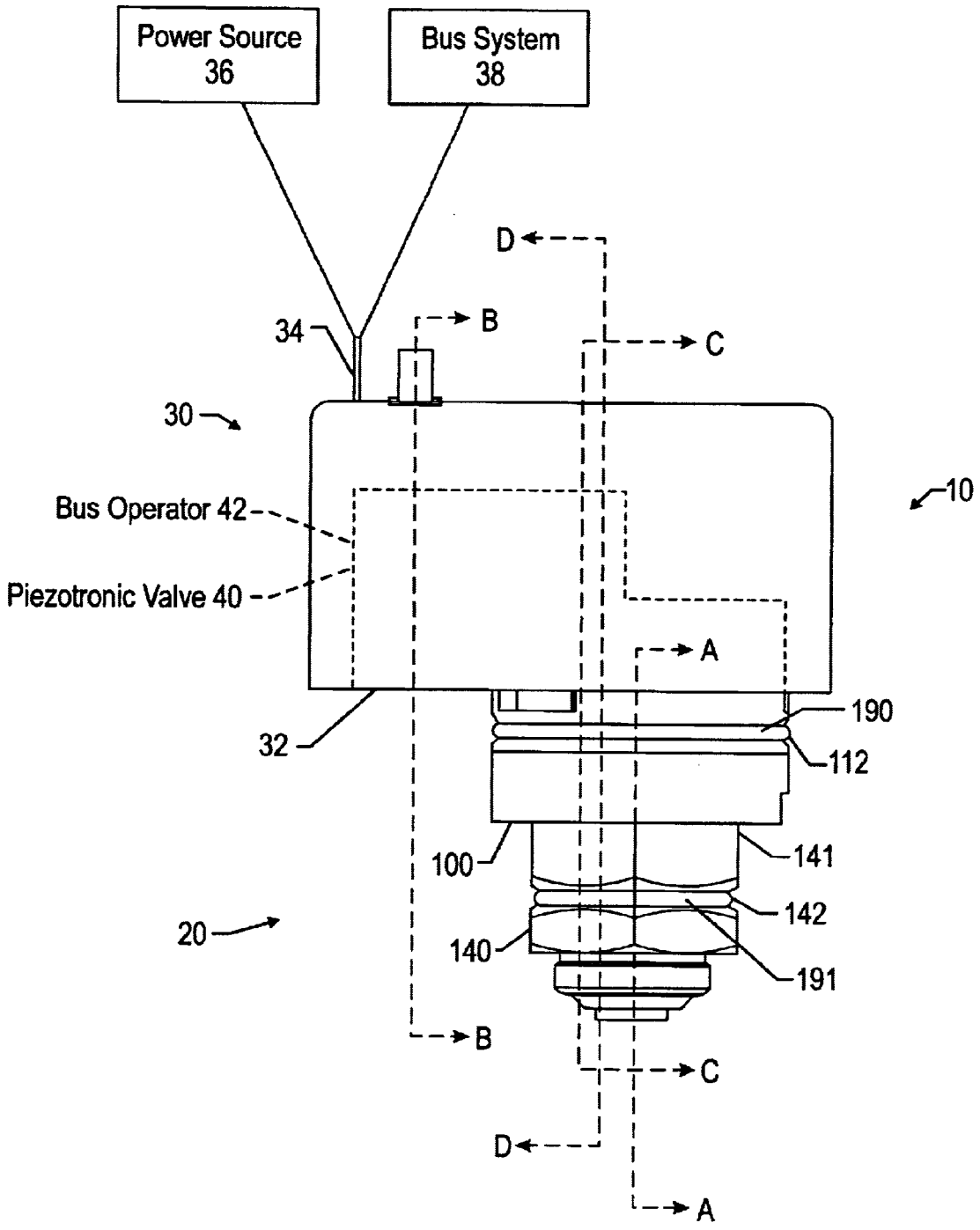
FIG. 1 illustrates a side view of a booster pilot valve in accordance with one aspect of the present invention.

While the invention described herein is susceptible to various modifications and alternative forms, only specific embodiments have been shown by way of example in the drawings and will be described in detail herein. However, it should be understood that the invention is not to be limited to or restricted by the particular forms disclosed herein.

DETAILED DESCRIPTION OF THE INVENTION

Referring to FIG. 1, a side view of a booster pilot valve 10 illustrates one embodiment of the present invention. The booster pilot valve 10 includes a primary valve 20 and a secondary device 30. The primary valve 20 facilitates connection with a main valve (not shown) and includes an adapter 100 and a body 140. The adapter 100 and the body portion 140 may comprise stainless steel or other materials. The body portion 140 may also be adapted to connect directly to a fluid source such as pressurized air.

The body 140 connects to the adapter 100 at a first end 141. In the present embodiment, the diameter of body 140 is smaller than the diameter of adapter 100 at the first end 141. Located around the periphery of primary valve 20 are an adapter recess 112 and a body recess 142. Adapter recess 112 circumscribes the adapter 100, and body recess 142 circumscribes the body 140. Adapter recess 112 and body recess 142 receive seals 190 and 191, respectively. The seals 190 and 191, which are preferably O-ring seals, seal an annulus formed between primary valve 20 and a main valve (not shown) when the two are connected.

The secondary device 30 is attached to the primary valve 20. The secondary device 30 includes a secondary valve 40, which is preferably a three-way valve. More particularly, the secondary valve 40 may preferably be a three-way piezotronic valve. In order to operate the booster pilot valve 10, the piezotronic valve 40 must have compatible electronics (not shown) to accept signals from an operating platform or a network Bus (not shown). In one embodiment, the booster pilot valve 10 may be provided with a Profibus PA operator, but other operators compatible with other Bus systems, including, but not limited to, Profibus DP, Fieldbus Foundation and DeviceNet may also be used. The operation of the primary valve 20, however, may not change with any alterations in electronics. With the benefit of this disclosure, one of skill in the art will recognize that the piezo-operated three-way valve 40 may be obtained from the Automated Switch Company (ASCO), but other three-way valves may also be used.

The piezotronic valve 40 advantageously requires very little power to operate, on the order of 100 mW with currents in the range of approximately 1.5 to 10 mA, which can be provided by the low-energy Bus system. The piezotronic valve 40 is shrouded by a cover 32. An electrical connector 34 extends from cover 32 for connection to a power source or the Bus system. The piezotronic valve 40 and any additional electronics may also be encapsulated in epoxy within the cover 32 for protection from the environment.

Figure 2:
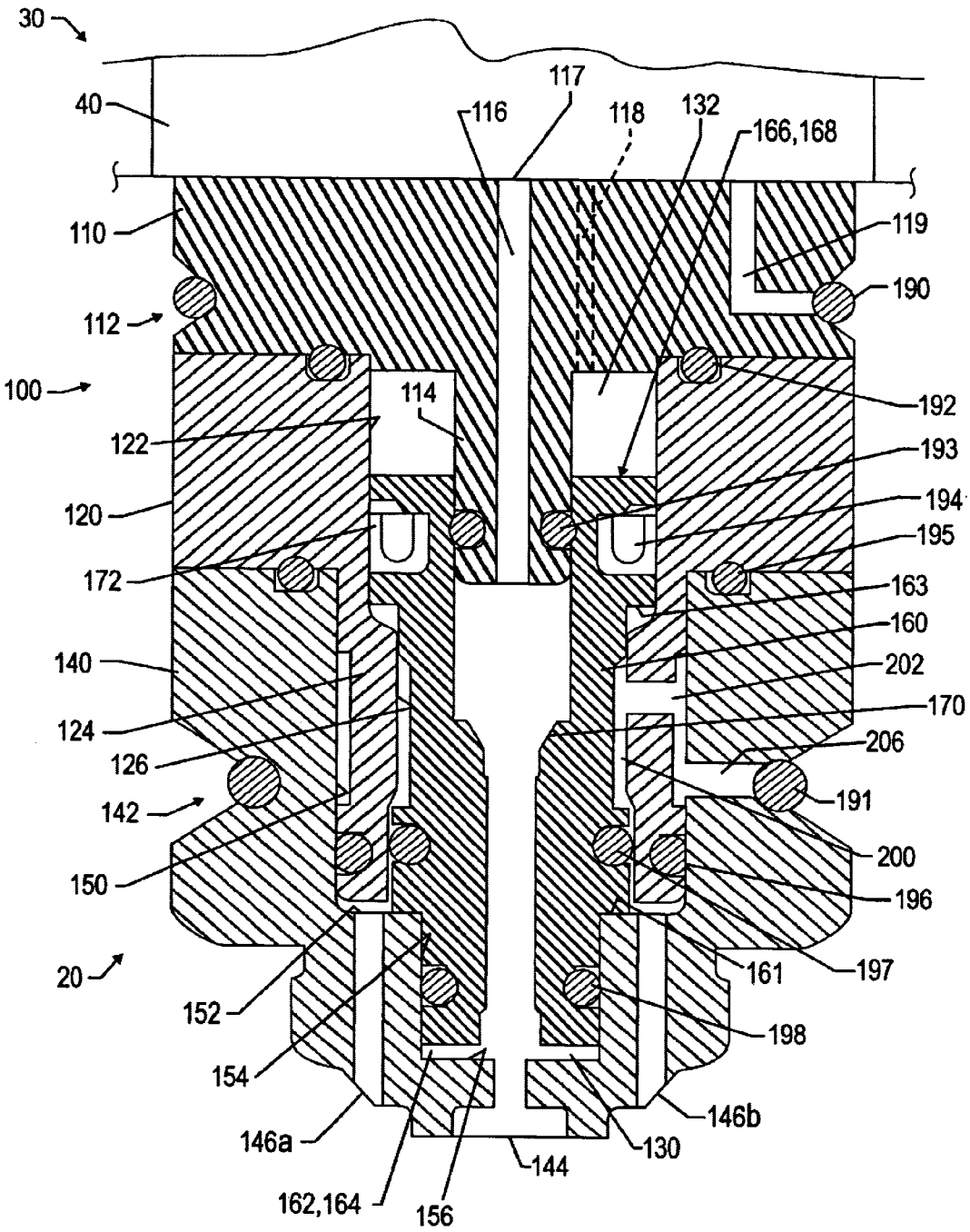
FIG. 2 illustrates a cross-sectional, detailed view of the booster pilot valve according to FIG. 1 taken along line A—A.

Referring to FIG. 2, a cross-section of the primary valve 20 of FIG. 1 taken along line A—A further illustrates the present invention. As before, the primary valve 20 includes the body 140 connected to the adapter 100. The primary valve 20 further includes a hydraulic member or spool 160. For simplicity, the fasteners and apertures for connecting the adapter 100, the body 140 and the secondary device 30 have been omitted from FIG. 2.

The adapter 100 includes a first adapter portion 110 and a second adapter portion 120. The first adapter portion 110 connects to the secondary device 30, and the second adapter portion 120 connects to the body 140. The first adapter portion 110 includes the adapter recess 112 circumscribing its periphery. The first adapter portion 110 further includes a protrusion or stem 114, an outlet port 116 and a fluid passageway 118. The protrusion 114 projects from the first adapter portion 110 into a first internal bore 122 in the second adapter portion 120. The outlet port 116 extends from a distal end of the protrusion 114 to an opening 117, which communicates with the secondary device 30 and more specifically with the piezotronic valve 40.

The second adapter portion 120 is connected to the first adapter portion 110. The second adapter portion 120 defines the first internal bore 122 that accommodates the protrusion or stem 114 of the first adapter portion 110. The first internal bore 122 has a greater diameter than that of the protrusion 114 so that a second plenum 132 is formed therebetween. The fluid passageway 118 is shown with dashed line to illustrate fluid communication between the piezotronic valve 40 and the second plenum 132. The actual location of the fluid passageway 118 may be on a dihedral plane to the cross-sectional plane of FIG. 2. Furthermore, additional ancillary ports (not shown) may communicate the piezotronic valve 40 with the second plenum 132. The second adapter portion 120 further includes an annular extension 124 extending therefrom. The annular extension 124 includes a second internal bore 126, which communicates with the first internal bore 122 but has a lesser diameter.

The body 140 includes the body recess 124 and further includes a main port 144 and cylinder ports 146*a–b*. The body 140 defines an internal bore having a first bore portion 150, a first shoulder 152, a second bore portion 154, and a second shoulder 156. The body 140 is connected to the second adapter portion 120 so that the annular extension 124 is disposed in the first bore portion 150. A decrease in diameter at the first shoulder 152 forms the second bore portion 154 that communicates with the first bore portion 150. The main port 144 communicates with the second bore portion 154 at the second shoulder 156, and the cylinder ports 146*a–b* communicate with the first bore portion 150 at the first shoulder 152.

The bores 150 and 152 of the body 140 and the internal bores 122 and 124 of the adapter 100 define a fluid chamber within the primary valve 20. The hydraulic member or spool 160, which may be constructed of stainless steel or other materials, is disposed within the fluid chamber of the primary valve 20 and is movable therein. Specifically, the spool 160 is partially disposed and movable within internal bore 122 of the second adapter portion 120 and partially disposed and movable within the internal bore 126 of the annular extension 124. The spool 160 is also partially disposed and movable within the second bore portion 154 of the body 140.

The spool 160 includes a first surface 164, a second surface 168 and a fluid passageway 170. A first end 162 of the spool 160 exhibits the first surface 164 adjacent to the shoulder 156 of the fluid chamber. A first plenum 130 of the fluid chamber is defined between the first surface 164 and the shoulder 156. A second end 166 of the spool 160 exhibits the second surface 168 within the fluid chamber. The second plenum 132 is further defined between the second surface 168 and the portion of the fluid chamber in the adapter 100.

In the present embodiment, the second surface 168 exhibits a greater surface area than the first surface 164. The greater surface area of the second surface 168 results in part from an increasing diameter of the spool 160. The diameter of the spool 160 increases at a shoulder 161 to approximately match the internal bore 126 of the annular extension 124. The spool 160 also exhibits another increase in diameter at a shoulder 163 so that the second end 164 approximately matches the internal bore 122 of the first adapter portion 110.

The fluid passageway 170 provides for fluid communication through the interior of the spool 160 and extends from the first surface 164 to the second surface 168. The protrusion or stem 114 of the first adapter portion 110 is partially disposed within the fluid passageway 170. A filter (not shown) may be disposed in the passageway 170. The filter may be commercially available and may filter particles, for example, to approximately fifty microns. The fluid passageway 170 communicates the main port 144 with the outlet port 116 of the primary valve 20. Thus, fluid (not shown) may communicate between the main port 144 and the three-way piezotronic valve 40.

Figure 6:
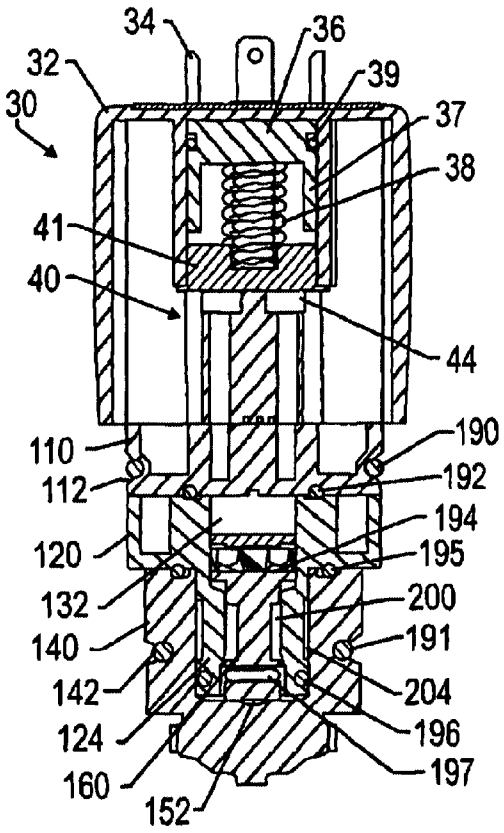
FIG. 6 illustrates a cross-sectional view of the booster pilot valve according to FIG. 1 taken along line D—D.
Figure 5:
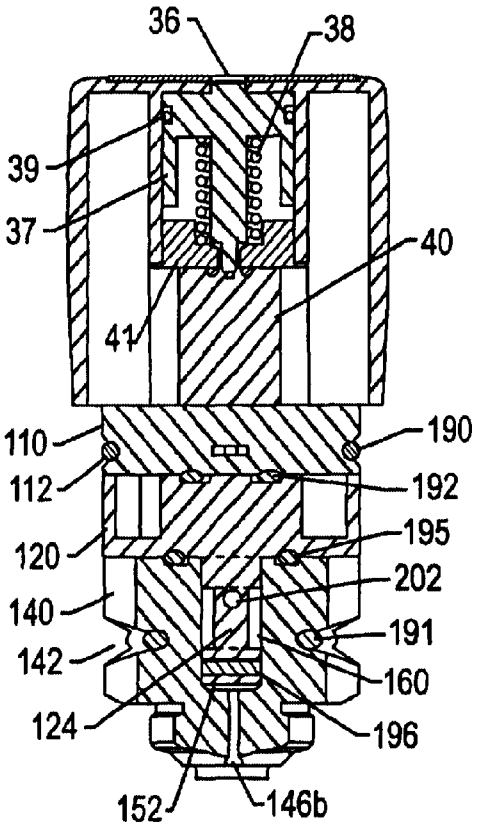
FIG. 5 illustrates a cross-sectional view of the booster pilot valve according to FIG. 1 taken along line C—C.

The primary valve 20 contains a plurality of seals used for both the connection and engagement of the components. Referring concurrently to FIGS. 2, 5 and 6, the adapter 100 includes the seals 192, 193, 195 and 196, which are preferably O-ring seals. The first adapter seal 192 seals the connection of the first adapter portion 110 to the second adapter portion 120. The second adapter seal 193 seals engagement of the protrusion 114 with the fluid passageway 170 of the spool 160. The third adapter seal 195 seals the connection between the adapter 100 and the body 140. The fourth adapter seal 196 seals connection of the annular extension 124 with the first internal bore 150 of the body 140.

The hydraulic member or spool 160 includes a plurality of seals for the engagement of the spool 160 with the fluid chamber of the primary valve 20. The spool 160 includes a seal 194, which is preferably a U-cup seal, and includes the seals 197 and 198, which are preferably O-ring seals. The U-cup seal 194, disposed in an annular recess 172, seals engagement of the spool 160 with the internal bore 122 of the second adapter portion 120. The U-cup seal 194 seals off fluid contained in the second plenum 132.

Figure 3B:
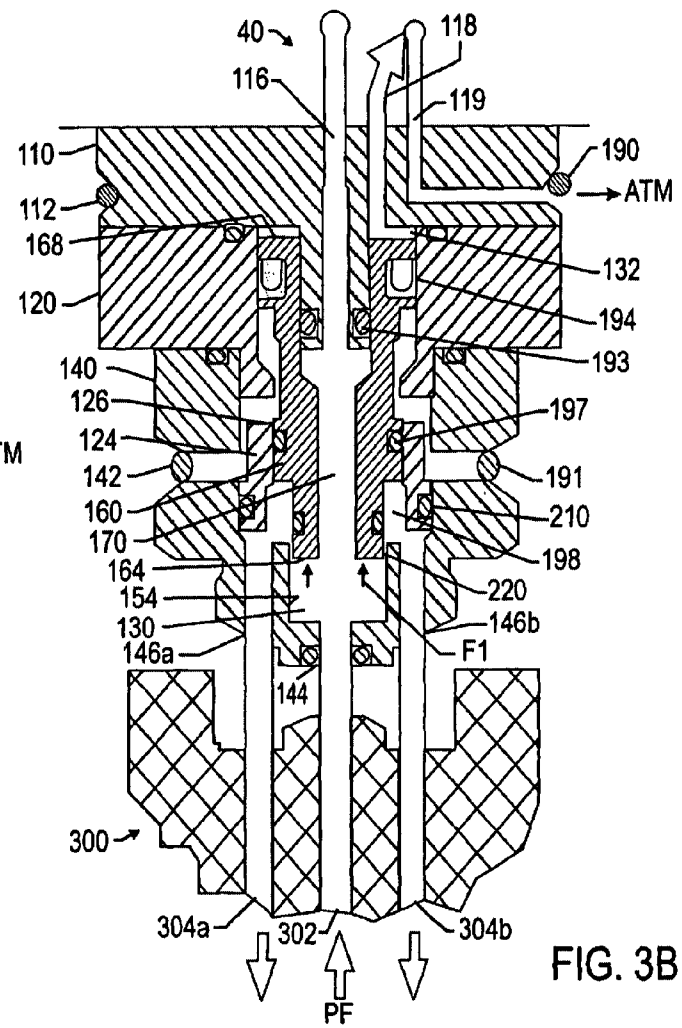
FIG. 3B schematically illustrates the booster pilot valve in a second or opened position in relation to the main valve.
Figure 3A:
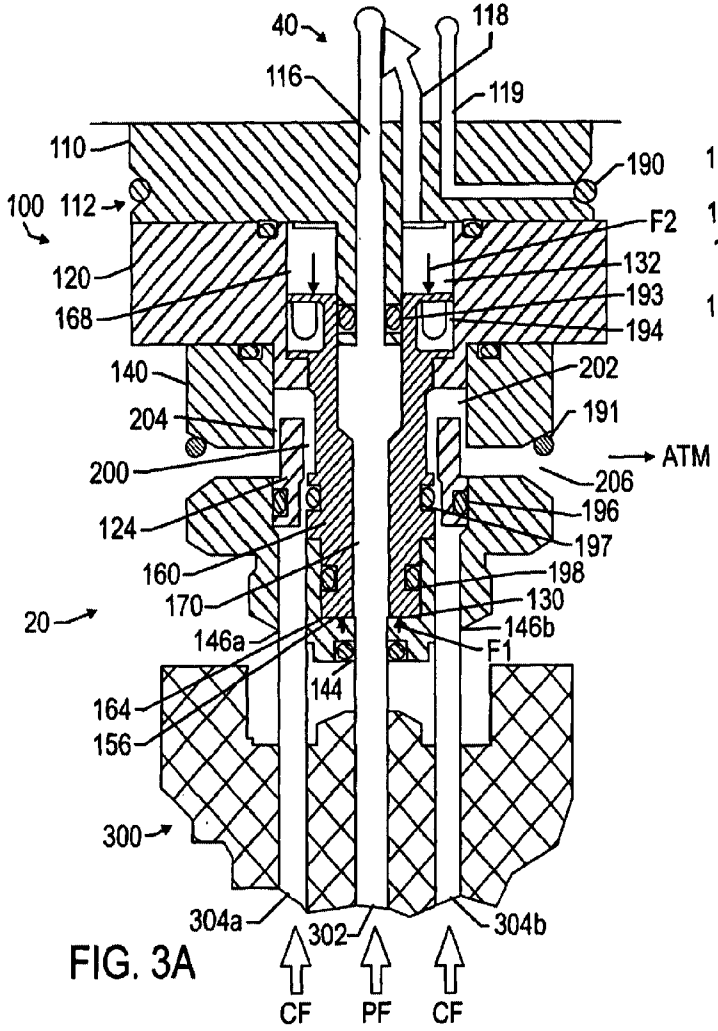
FIG. 3A schematically illustrates the booster pilot valve in a first or closed position in relation to a main valve.

The seal 197 seals the engagement between the spool 160 and the annular extension 124 when the spool 160 is appropriately positioned within the fluid chamber. With the spool 160 in a first position as shown in FIGS. 2 and 3A, the seal 197 lacks engagement with the internal bore 126. Fluid communication is thus permitted from the cylinder ports 146*a–b* to a first annulus 200 between the spool 160 and the adapter extension 124. When the spool 160 is moved to a second position as shown in FIG. 3B, the seal 197 engages the internal bore 126 of the annular extension 124 and seals the fluid communication of the cylinder ports 146*a–b* with the first annulus 200. The seal 198 seals the engagement of the spool 160 with the second bore portion 154 of the body 140 when the spool 160 is appropriately positioned within the fluid chamber. Further details regarding the engagement of the seals in the primary valve 20 are provided below with reference to FIGS. 3A and 3B.

In a general description of the operation of the primary valve 20, pressurized fluid (not shown) may enter the fluid chamber of the primary valve 20 though the main port 144. The pressurized fluid may concentrate in the first plenum 130. With the application of pressure from the pressurized fluid to the first surface 164, a first force may be produced that urges the spool 160 to move within the fluid chamber and distance from the shoulder 156. The pressurized fluid may also pass through the fluid passageway 170 and into the piezotronic valve 40 via the outlet port 116. The pressurized fluid may be directed by the piezotronic valve 40 to the second plenum 132 via the fluid passageway 118. With the application of pressure from the pressurized fluid to the second surface 168, a second force may be produced that urges the spool 160 to move within the fluid chamber and distance from the first adapter portion 110. Fluid in the second plenum 132 may be further vented by communicating the piezotronic valve 40 with the adapter recess 112 via a first ancillary port 119 at the adapter recess 112.

Moreover, when the spool is in the second or closed position as shown in FIG. 2, a second fluid flow (not shown) may communicate from the cylinder ports 146*a–b* to the first annulus 200, to an opening 202, to a second annulus 204, to a second ancillary port 206 and to the body recess 142. The first annulus 200 is formed between the spool 160 and the annular extension 124. The opening 202 is defined in the annular extension 124 of the second adapter portion 120. The opening 202 communicates the first annulus 200 with the second annulus 204. The second annulus 204 is formed between the annular extension 124 and the first internal bore 150 of the body 140. Only one opening 202 is shown, but a number of similar openings may be formed circumscribing the annular extension 124. The second ancillary port 206 communicates the second annulus 204 with the body recess 142, where the second fluid may be vented. Further details regarding the movement of the spool 160, the flow of fluid and the operation of the booster pilot valve 10 are provided below with reference to FIGS. 3A and 3B.

Referring now to FIGS. 3A–3B, the operation of the booster pilot valve 10 is schematically illustrated. As before, the booster pilot valve 10 includes the primary valve 20 connected to the secondary device 30. The primary valve 20 includes the adapter 100, the body 140 and the movable spool 160 as described above. The secondary device 30 includes a secondary valve 40, which is shown here schematically. The secondary valve 40 is preferably a three-way valve requiring low power levels to operate, such as the piezotronic valve as discussed above.

In some embodiments, the booster pilot valve 10 may be used in series with at least one other pilot operated valve, such as the main valve 300 of FIGS. 3A–3B. The booster pilot valve 10 may be capable of operating at very low power levels, but may not be able to provide an adequate flow rate of pressurized fluid to actuate a large valve in a reasonable time period. Therefore, the booster pilot valve 10 may only actuate another pilot operated valve, which may in turn directly actuate a large valve or in some cases may actuate yet another pilot operated valve. One advantage of the booster pilot valve 10, however, is that it can operate at even the lowest Bus power levels, and thus begin a "stepping up" process to other pilot valves. The other pilot valve can eventually provide the necessary flow rate of pressurized fluid to ultimately operate the large valve. In other embodiments, the booster pilot valve 10 may be the only pilot valve used.

The primary valve 20 connects to a main valve 300. The main valve 300 communicates a pressurized working fluid PF to the primary valve 20 via a main line 302. The pressured fluid PF represents a main flow ultimately intended to operate a large-valve actuator (not shown) or other pilot valve, such as main valve 300. Conventional pilot valves use flow that is controlled by or flows through only the pilot valve itself. Advantageously, the booster pilot valve 10 of the present invention uses the pressurized flow PF to also influence the orientation of the spool 160, which in turn redirects the path of pressurized fluid PF in the manner described below.

The main valve 300 also communicates a second fluid CF from a cylinder (not shown) via cylinder lines 304*a–b*. The cylinder lines 304*a–b* communication the cylinder fluid CF between the cylinder and the booster pilot valve 10. The cylinder may also be in communication with main valve 300 or other valves, and the cylinder may be, but is not limited to, a reservoir used to open/close another valve or to extend/retract a piston. The cylinder fluid CF may come from a closing cylinder (not shown) for the piloted valve 300 or from an actuator volume (not shown) that is being exhausted.

Referring to FIG. 3A, the pressurized fluid PF is constantly supplied from the main valve 300. The pressurized fluid PF enters the booster pilot valve 10 through the main port 144 and is permitted to concentrate within the first plenum 130 between the first surface 164 and the shoulder 156. The pressure of the fluid PF is transmitted to the lower surface 164 of the spool 160. Consequently, the pressurized fluid PF acting against the area of the lower surface 164 creates a first force $F_1$ on the spool 160.

The pressurized fluid PF is also permitted to pass through the fluid passageway 170 to the piezotronic valve 40 via the outlet port 116. In FIG. 3A, the piezotronic valve 40 is de-energized and communicates the pressurized fluid PF from the outlet port 116 to the second plenum 132 via the fluid passageway 118. The pressurized fluid PF is permitted to concentrate in the second plenum 132 and apply pressure to the second surface 168. Consequently, a second force $F_2$ is produced on the spool 160 that opposes the first force $F_1$.

The area of the second surface 168 is preferably greater than the area of the first surface 164. Therefore, the second force $F_2$ on the spool 160 is larger than the first force $F_1$. The force differential ($F_2$–$F_1$) tends to urge the spool 160 to a first or closed position illustrated in FIG. 3A when the piezotronic valve 40 is de-energized. Designing the areas of the first and second surfaces 164, 168 to urge the spool 160 to the first or closed position with the pressurized fluid PF and to overcome frictional forces is well within the ordinary skill of one in the art.

With the spool 160 in the first or closed position, the seal 198 seals the fluid communication of the main port 144 from the cylinder ports 146*a–b*. The seal 197 lacks sealed engagement with the annular extension 124 of the adapter 100. Consequently, the cylinder ports 146*a–b* are in fluid communication with the first annulus 200 between the spool 160 and the adapter 100, and the cylinder fluid CF is permitted to flow from the cylinder ports 146*a–b* to the first annulus 200. From the first annulus 200, the cylinder fluid CF is permitted to flow through the opening 202 in the adapter extension 124 and into the second annulus 204 created between the adapter extension 124 and the body 140. Finally, the cylinder fluid CF may vent to the atmospheric pressure through the second ancillary port 206 in the body recess 142. Thus, by de-energizing the three-way piezotronic valve 40, the spool 160 of the booster pilot valve 10 may be moved to the first or closed position with the pressurized fluid PF and may vent the cylinder fluid CF when the cylinder closes.

Referring now to FIG. 3B, the path of the pressurized fluid PF within the booster pilot valve 10 has been altered to actuate the main valve 300 or some other valve for which main valve 300 is a pilot. As schematically illustrated, the piezotronic valve 40 is energized. The flow of pressurized fluid PF is restricted at the outlet port 116 by the piezotronic valve 40, and the pressurized fluid PF is permitted to concentrate in the fluid chamber of the primary valve 20. In addition, a new flow path is created by the three-way piezotronic valve 40 between the fluid passageway 118 and the first ancillary port 119. The first ancillary port 119 leads to atmospheric pressure at the adapter recess 112, enabling any pressurized fluid PF trapped in the second plenum 132 to escape.

With the fluid passageway 118 in fluid communication with the first ancillary port 119, the force on the second surface 168 subsides and only the Force $F_1$ on the first surface 164 predominates. Consequently, the Force $F_1$ urges the spool 160 into a second or opened position as shown in FIG. 3B. As the spool 160 moves within the fluid chamber, the seal 198 disengages the second bore portion 154 of the body 140, and the seal 197 engages the internal bore 126 of the adapter extension 124. A gap 220 is created between the spool 160 and the body 140, which facilitates fluid communication of the pressurized fluid PF from the main port 144 to the cylinder ports 146*a–b*.

The pressurized fluid PF is permitted to flow through the gap 220 to the cylinder ports 146*a–b*. The pressurized fluid PF may further act on a pressure area 210 to drive the spool 160 the remaining stroke within the fluid chamber. The pressurized fluid PF is then directed out of the cylinder ports 146*a–b*, through the cylinder lines 304*a–b* in the main valve 300 and to the cylinder. The pressurized fluid PF may provide working pressure to actuate the main valve 300 that may be in communication with the cylinder. Thus, by energizing the three-way piezotronic valve 40, the spool 160 of the booster pilot valve 10 may be moved to the second or opened position with the pressurized fluid PF and may actuate another larger valve.

Referring now to FIGS. 4–9, the embodiment of the booster pilot valve 10 is illustrated in a number of principle views. In the discussion that follows and for the sake of brevity, only certain features are described for each view. The same reference numerals are used in the FIGS. 4–9 to represent the same components in each view.

Figure 4:
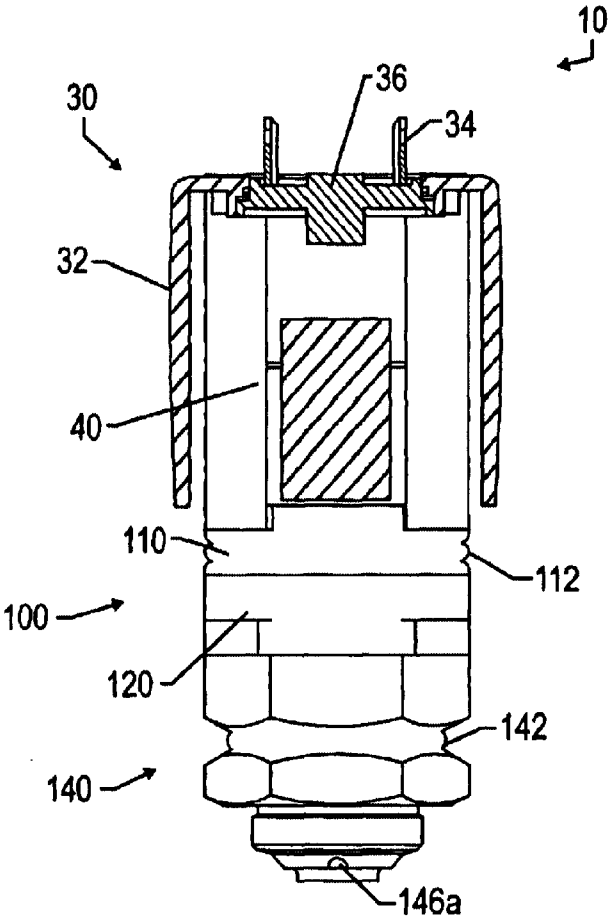
FIG. 4 illustrates a cross-sectional view of the booster pilot valve according to FIG. 1 taken along line B—B.
Figure 7:
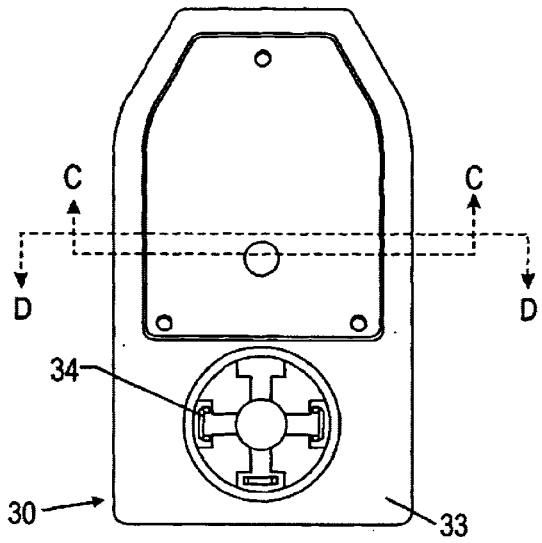
FIG. 7 illustrates a top view of the booster pilot valve according to the present invention.
Figure 8:
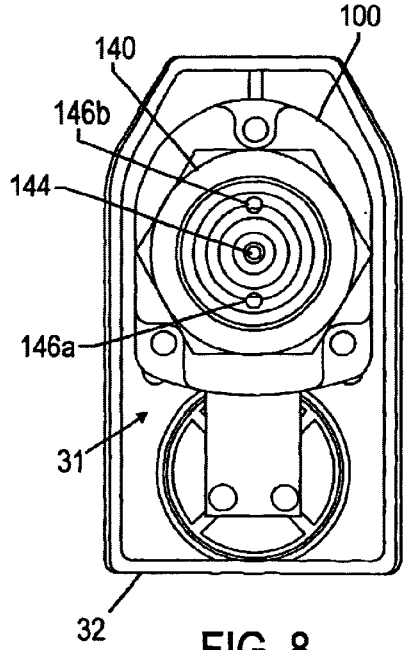
FIG. 8 illustrates a bottom view of the booster pilot valve according to the present invention.
Figure 9:
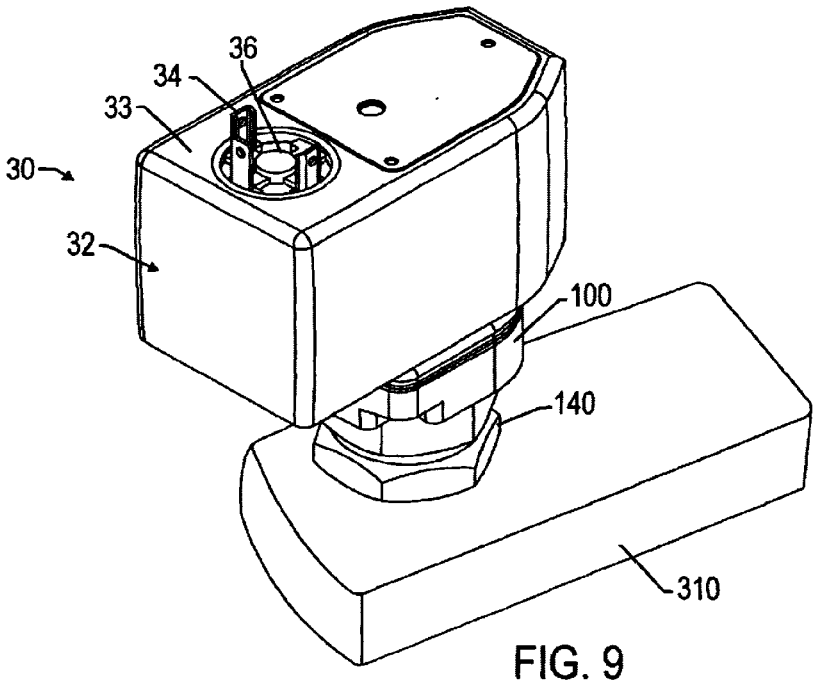
FIG. 9 illustrates a perspective view of the booster pilot valve connected to a larger valve.

In FIGS. 4–6, the embodiment of the booster pilot valve 10 is illustrated in various cross-sections. FIG. 4 illustrates a cross-sectional view of the booster pilot valve according to FIG. 1 taken along line B—B. FIG. 5 illustrates a cross-sectional view of the booster pilot valve 10 according to FIG. 1 taken along line C—C. FIG. 6 illustrates a cross-sectional view of the booster pilot valve 10 according to FIG. 1 taken along line D—D. In FIGS. 7—9, the embodiment of the booster pilot valve 10 is illustrated in a top view, a bottom view and a perspective view respectively.

The secondary device 30 may include a push button activation system. The system may include a manual push button 36, a spring 38, and a gasket 41. The manual push button 36 may be included on the cover 32 to activate the piezotronic valve 40. The spring 38 returns the push button 36 to the deactivated position shown in the figures. The button 36 includes stems 37 to guide the movement of the button 36 within the cover 32. The gasket 41 may be provided between the piezotronic valve 40 and the button 36. Bolts 44 may attach the piezotronic 42 to the primary valve 20. With the benefit of this disclosure, it will be understood by one of skill in the art that the push button activation system may be omitted.

Particularly illustrated in FIGS. 5 and 6, the seals 190–198 as described in FIG. 2 are illustrated at differing points of cross-section than illustrated in FIG. 2. The cylinder port 146*b* is shown in cross-section communicating with the first shoulder 152. Additionally, the opening 202 defines a radial bore in the annular extension 124. The opening 202 communicates fluid from the first annulus 200 formed between the spool 160 and adapter extension 124 to the second annulus 204 formed between the adapter extension 124 and the body 140 as described above.

In the bottom view of FIG. 8, the location of the main port 144 and cylinder ports 146*a–b* are illustrated in the bottom of the body 140. Also, the PC board 31 holding the piezotronic valve (not shown) and additional electronics (not shown) is visible within the cover 32. Particularly illustrated in FIG. 9, the booster pilot valve 10 is shown connected to a larger valve 310. The booster pilot valve 10 may pilot the larger valve 310: however; it will be understood by one of skill in the art with the benefit of this disclosure that booster pilot valve 10 is not limited to piloting the larger valve 310, but may pilot other valves as well.

While the invention has been described with reference to the preferred embodiments, obvious modifications and alterations are possible by those skilled in the related art. Therefore, it is intended that the invention include all such modifications and alterations to the full extent that they come within the scope of the following claims or the equivalents thereof.

What is claimed is:

1. A booster pilot valve operated by a pressurized fluid, comprising:

a body defining a fluid chamber having a main port for receiving the pressurized fluid, a cylinder port, an exhaust port, and outlet port;

a hydraulic member movably disposed in the fluid chamber between a closed position and an opened position without a spring biasing the hydraulic member, the hydraulic member defining a fluid passageway that extends from a first hydraulic member area to a second hydraulic member area and that communicates at least a portion of the pressurized fluid from main port to the outlet port;

a first motive force generated by the pressurized fluid from the main port reacting against first hydraulic member area; and a second motive tree generated by the portion of the pressurized fluid from the outlet port reacting against the second hydraulic member area, which area is greater than the first area, wherein during one operational state the second motive force moves the hydraulic member to the closed position and the hydraulic member facilitates communication between the cylinder port and the exhaust port, and wherein during another operational state the first motive force moves the hydraulic member to the opened position and the hydraulic member facilitates communication of at least a portion of the pressurized fluid from the main port with the cylinder port.

2. The booster pilot valve of claim 1, wherein the body comprises a stem having the outlet port and partially disposed within the fluid passageway of the hydraulic member.

3. The booster pilot valve of claim 1, further comprising a secondary device operable to direct the portion of the pressurized fluid from the outlet to the second hydraulic member area.

4. The booster pilot valve of claim 3, wherein the secondary device vents the portion of the pressurized fluid from the second area to an ancillary port for moving the hydraulic member to the opened position during the other operational state.

5. The booster pilot valve of claim 3, wherein the secondary device directs the portion of the pressurized fluid from the outlet to the second area for moving the hydraulic member to the closed position during the one operational state.

6. A booster pilot valve operated by a pressurized fluid, comprising:

a body defining a fluid chamber having a main port for receiving the pressurized fluid, a cylinder port, an exhaust port, and an outlet port;

a spool movably disposed within the fluid chamber between a closed position and an opened position without a spring biasing the spool, the spool defining a fluid passageway that extends from a first spool area to a second spool area and that communicates at least a portion of the pressurized fluid from the main port to the outlet port;

a first motive force generated by the pressurized fluid from the main reacting against the first spool area;

a second motive force generated by the portion of the pressurized fluid from the outlet port reacting against the second spool area, which area is greater than the first area; and a secondary valve communicating with the outlet port of the body and operable to direct the portion of the pressurized fluid from the outlet port to the second spool area or to vent the portion of the pressurized fluid from the second spool area, wherein during one operational state the secondary valve directs the portion of the pressurized fluid from the outlet to the second spool area, the second motive force moves the spool to the closed position, and the hydraulic member facilitates communication between the cylinder port and the exhaust port, and wherein during another operational state the secondary valve vents the portion of the pressurized fluid from the second area, the first motive force moves the spool to the opened position, and the hydraulic member facilitates communication of at least a portion of the pressurized fluid from the main port with the cylinder port.

7. The booster pilot valve of claim 6, wherein the spool is engaged with the fluid chamber of the body with a plurality of seals.

8. The booster pilot valve of claim 6, wherein the body comprises a protrusion having the outlet port and partially disposed in the fluid passageway of the spool.

9. The booster pilot valve of claim 6, wherein the secondary valve comprises a three-way valve.

10. The booster pilot valve of claim 6, wherein the secondary valve comprises a piezotronic valve.

11. The booster pilot valve of claim 10, wherein the piezotronic valve comprises a Bus operator to accept signals from a network Bus.

12. The booster pilot valve of claim 10, wherein the piezotronic valve operates using a current supply of approximately 1.5 mA to 10 mA.

13. The booster pilot valve of claim 12, wherein the piezotronic valve operates using a power supply of approximately 100 mW.

14. The booster pilot valve of claim 10 wherein the piezotronic valve is adapted to accept signals from a network Bus.

15. The booster pilot valve of claim 10, wherein the piezotronic valve operates over a current range of approximately 1.5 mA to 10 mA.

16. The booster pilot of claim 15, wherein the piezotronic valve operates at a power level of approximately 100 mW.

17. A booster pilot valve operated by a pressurized fluid, comprising:

a body defining a fluid chamber, comprising:

a main port defined in a first end of the fluid chamber for receiving the pressurized fluid, an exhaust port defined in the fluid chamber, and a stem defining an outlet port and protruding into the fluid chamber from a second end of the fluid chamber;

a hydraulic member movably disposed in the fluid chamber between an opened position and a closed position without a spring biasing the hydraulic member, comprising:

a first area adjacent the first end of the fluid chamber;

a second area adjacent the second end of the fluid chamber, which area being greater than the first area, a fluid passageway defined in the hydraulic member and extending from the first area to the second area, at least a portion of the stem disposed within the fluid passageway so that the fluid passageway communicates the main port with the outlet port;

a first motive force generated by the pressurized fluid from the main port reacting against the first hydraulic member area; and a second motive force generated by at least a portion of the pressurized fluid from the outlet port reacting against the second hydraulic member area, wherein during one operational state the first motive force moves the hydraulic member to the opened position and the hydraulic member facilitates communication of at least a portion of the pressurized fluid from the main port with the cylinder port, and wherein during another operational state the second motive force moves the hydraulic member to the closed position and the hydraulic member facilitates communication between the cylinder port and the exhaust port.

18. The booster pilot valve of claim 17, wherein the hydraulic member is engaged with the fluid chamber with a plurality of seals.

19. The booster pilot valve of claim 18, wherein a first seal seals the main port from the cylinder port when the hydraulic member is in the closed position.

20. The booster pilot valve of claim 19, wherein a second seal seals the cylinder port from the exhaust port when the hydraulic member is in the opened position.

21. The booster pilot valve of claim 17, further comprising a three-way valve in fluid communication with the fluid chamber via the outlet port.

22. The booster pilot valve of claim 21, wherein the three-way valve is vents pressurized fluid from a plenum defined between the second area and the second end for moving the hydraulic member to the opened position.

23. The booster pilot valve of claim 21, wherein the three-way valve comprises a piezotronic valve.

24. The booster pilot valve of claim 21, wherein the three-way valve directs pressurized fluid from the outlet port to the plenum defined between the second area and the second end for moving the hydraulic member to the closed position.

25. The booster pilot of claim 24, wherein a passageway in the body communicates the three-way valve with the plenum for directing or venting pressurized fluid thereto.

26. The booster pilot of claim 25, wherein an ancillary port in the body communicates with the three-way valve for venting pressurized fluid from the plenum.

27. A method of operating a valve element with a hydraulic device, a pressurized fluid, and a three-way valve operable to direct the pressurized fluid, the hydraulic device having a first area and having a second area greater than the first area, the hydraulic device movably disposed in a fluid chamber without a spring biasing the hydraulic member, the method comprising:

supplying the pressurized fluid into the fluid chamber having the hydraulic device movably disposed therein;

generating a first motive force on the hydraulic device with the pressurized fluid by reacting the pressurized fluid on the first area and by venting a portion of the pressurized fluid from the second area with the three-way valve;

generating a second motive force on the hydraulic device by reacting the pressurized fluid on the first area and by directing a portion of the pressurized fluid with the three-way valve to react against the second area;

directing at least a portion of the pressurized fluid to the valve element by moving the hydraulic device to an opened position with the first motive force; and exhausting a secondary fluid from the valve element by moving the hydraulic device to a closed position with the second motive force.

28. The method of claim 27, wherein directing the pressurized fluid to the valve element comprises sealing the secondary fluid from communicating with an exhaust port defined in the fluid chamber.

29. The method of claim 27, wherein exhausting the secondary fluid from the valve element comprises sealing the pressurized fluid from communicating with the valve element.

* * * * *

UNITED STATES PATENT AND TRADEMARK OFFICE

CERTIFICATE OF CORRECTION

PATENT NO. : 6,644,351 B2
DATED : November 11, 2003
INVENTOR(S) : LaMarca et al.

It is certified that error appears in the above-identified patent and that said Letters Patent is hereby corrected as shown below:

Column 9,
Line 41, please insert -- the -- before “first”.

Column 10,
Line 19, please insert -- port -- after “main”.

Column 11,
Line 51, please delete “is” after “valve”.

Signed and Sealed this

Sixth Day of April, 2004

JON W. DUDAS
*Acting Director of the United States Patent and Trademark Office*